United States Patent [19]

Steimel

[11] 4,140,282

[45] Feb. 20, 1979

[54] COMMINUTER FOR METAL TURNINGS AND THE LIKE

[76] Inventor: Richard Steimel, Frankfurter Strasse 134, 5202 Hennef, Sieg, Fed. Rep. of Germany

[21] Appl. No.: 735,607

[22] Filed: Oct. 26, 1976

[30] Foreign Application Priority Data

Oct. 27, 1975 [DE] Fed. Rep. of Germany ..... 2547980

[51] Int. Cl.[2] ..... B02C 13/282; B02C 13/286

[52] U.S. Cl. ..... 241/36; 241/154; 241/188 R; 241/191; 241/248

[58] Field of Search ..... 241/154, 159, 160, 186 R, 241/189 R, 189 A, 188 R, 190–191, 245, 247, 163, 248, 36, 152 R, 155, 162

[56] References Cited

U.S. PATENT DOCUMENTS

| | | | |
|---|---|---|---|
| Re. 8,845 | 8/1879 | Taylor | 241/162 |
| 190,777 | 5/1877 | Mosser | 241/162 |
| 587,641 | 8/1897 | Brown | 241/248 |
| 620,884 | 3/1899 | Cadwgan | 241/248 |
| 1,155,353 | 10/1915 | Haldeman | 241/248 |
| 1,415,861 | 5/1922 | Bing | 241/162 |
| 1,687,886 | 10/1928 | Philipp | 241/162 |
| 1,762,592 | 6/1930 | Schwarz | 241/162 |
| 2,392,958 | 1/1946 | Tice | 241/186 R |
| 2,742,937 | 4/1956 | Herger | 241/245 |
| 2,797,052 | 6/1957 | Clark | 241/186 R |
| 2,893,649 | 7/1959 | Mischanski | 241/162 |
| 2,974,701 | 3/1961 | Eberman | 241/245 |
| 3,011,220 | 12/1961 | Keller et al. | 241/154 |
| 3,053,297 | 9/1962 | Brundler | 241/162 |
| 3,077,007 | 2/1963 | Coghill | 241/247 |
| 3,973,735 | 8/1976 | Ito et al. | 241/163 |

*Primary Examiner*—Gerald A. Dost
*Attorney, Agent, or Firm*—Michael J. Striker

[57] ABSTRACT

A comminuter for metal turnings and the like has a rotor rotatable on a support about a fixed axis and carrying at least one outer rotor element and at least one inner rotor element which define a cylindrical orbit on rotation of the rotor. A housing surrounds this rotor and is formed by a U-shaped upwardly open portion of non-tapering cross-sectional shape and a flat cover part engageable over the open upper side and openable in order to clear a jam in the machine. Stator elements carried on this housing are spaced slightly from the rotor element so that as the rotor turns turnings and the like fed to the machine will be comminuted and passed from an inlet to an outlet end.

25 Claims, 12 Drawing Figures

COMMINUTER FOR METAL TURNINGS AND THE LIKE

BACKGROUND OF THE INVENTION

The present invention relates to a comminuting apparatus. More particularly this invention concerns such an apparatus used for comminuting turning and the like.

The turnings produced by metal working operations and the like are readily recyclable, but extremely difficult to handle in their normal state. For this reason it is common practice to comminute such turnings, that is to reduce them to small particles or pieces that can readily be handled.

Such a comminuting apparatus normally has a rotor carried on a support and rotatable about an axis fixed relative to this support. At least one outer rotor element and at least one inner rotor element are spaced axially apart on the rotor and define respective orbits that are centered on the axis of rotation of the rotor. A housing normally formed as a body of revolution centered on the rotation axis for the rotor contains this rotor and is provided with one or more stator elements juxtaposed with the orbits. The turnings to be comminuted are fed axially into one end of the interior of this housing as the rotor moves at high speed so that the turnings are cut and torn apart between the stator and rotor elements, eventually issuing from the other axial end of the housing via an outlet.

In such devices, the housing is normally of decreasing cross-sectional size from the inlet toward the outlet. A harpoon-type or pusher-type feeder is provided upstream of the rotor for advancing the turnings toward this rotor. Thus the orbit of the outer rotor element normally carried on a so-called breaker arm is larger in diameter than the orbit of the inner rotor element.

Such comminuters periodically become jammed up. The turnings become wedged between the side of the housing and the rotor elements so that the rotor can no longer rotate, the motor driving it overloads and the thermal cutout shuts the machine down. It is then necessary for the operator of the machine to reach into the inlet and pull out the wedged-in masses of turnings. These turnings are normally very sharp, coated with oil and wedged tightly in placed so that this is an extremely onerous task. Furthermore such a machine will almost invariably jam up if a relatively massive object which cannot be sheared in half or torn in half by the interaction of the rotor and stator elements is fed into it.

SUMMARY OF THE INVENTION:

It is therefore an object of the present invention to provide an improved comminuting apparatus.

Yet another object is to provide a comminuter for metal turnings and the like.

A further object is to provide a comminuting apparatus which has a reduced tendency to become jammed.

Yet another object is the provision of a comminuter for metal turnings which can readily be cleared should it become jammed.

These objects are attained according to the present invention in a comminuting apparatus of the above-described general type wherein the housing is formed of a generally U-section or trough-like part having an upwardly open side, and of a flat cover plate which can be displaced between a position overlying this side and a position spaced from the side. Thus it is possible to move this cover plate to the side and gain ready access to the entire rotor assembly. Furthermore this particular shape forms a pair of corner spaces in the housing which lie outside the orbits of the rotor elements and allow excess material to be comminuted to build up in these spaces if necessary. Since, however, these spaces lie above the rotor, simple gravity will tend to draw them out of these spaces when the machine is less full.

According to yet another feature of this invention the various housing parts, that is the cover and the trough, extend axially so that the housing is of constant cross-sectional size and shape along the entire rotor. Upstream of the rotor an axially flaring filling or input funnel is provided which forms an even continuation of the housing, that is the downstream end of the funnel fits exactly with the upstream end of the housing.

In accordance with another feature of this invention the stator elements in the housing are provided at their sides turned angularly into the direction of rotation of the rotor with angularly or tangentially projecting hooks. Thus turnings are caught on these hooks and ripped apart by the rotor moving at high speed. These stator elements can lie on an imaginary helix so inclined as to move the material being comminuted toward the output. Furthermore the stator elements may project radially inwardly of the orbit of at least the outer rotor element to either axial side of this orbit.

According to yet another feature of this invention the outer rotor element mounted on the breaker arm has an upper edge which is inclined into the rotation direction so as to urge the material downwardly toward the outlet end.

Outlet openings of relatively small cross-sectional size may also be provided upstream of the outlet, thus very small pieces of turnings that do not need further comminution can pass laterally out of the housing at this point and, therefore, unload the machine to at least a limited extent. In addition the cutting and cooling oil on the turnings can leave the machine at this location.

The bight portion of the trough-shaped housing part extends parallel to the rotor axis which itself forms an angle of between 45° and 75° to the horizontal. This type of arrangement can therefore work without a feeder in the inlet funnel, althrough it lies within the scope of this invention to provide a pusher-type reciprocating feeder in this inlet funnel. Such an inlet funnel has in accordance with the present invention an upper wall which extends vertically from the cover part of the housing and a lower wall which lies at an angle of between 50° and 75° to the horizontal.

According to yet another feature of this invention the rotation axis of the rotor may be horizontal. It is necessary to provide in such an apparatus a horizontally reciprocal feeder having forwardly pointing hooks so as to push the material to be comminuted toward the rotor in the horizontally opening inlet funnel. Such a device may also be provided on the top wall of the inlet funnel immediately upstream of the outer end of the rotor with an upwardly deflectable flap connected to a switch. When this flap is pushed up due to a large mass of turnings being present immediately upstream of the rotor means connected to the switch and to the reciprocating feeder automatically slow down or stop the feed rate altogether so as to prevent the machine from becoming jammed.

The inner rotor element in accordance with this invention is a fine comminuter and extends at least 1.0 centimeters beyond the respective stator element. The various stator and rotor elements can be carried on respective segments constituting linings for the housing or pieces of the rotor. Such construction makes the machine usable in very heavy-duty applications. In particular it is possible to provide the stator elements as teeth formed on 90 degree segments of a circular annulus. Two such segments are used and the other side of the annulus is closed by a 180 degree segment having no teeth. This 180 degeree segment lies on the upper side and has an inner surface spaced slightly from the orbit of the rotor elements so that the rotor is evenly radially loaded throughout its circumference.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
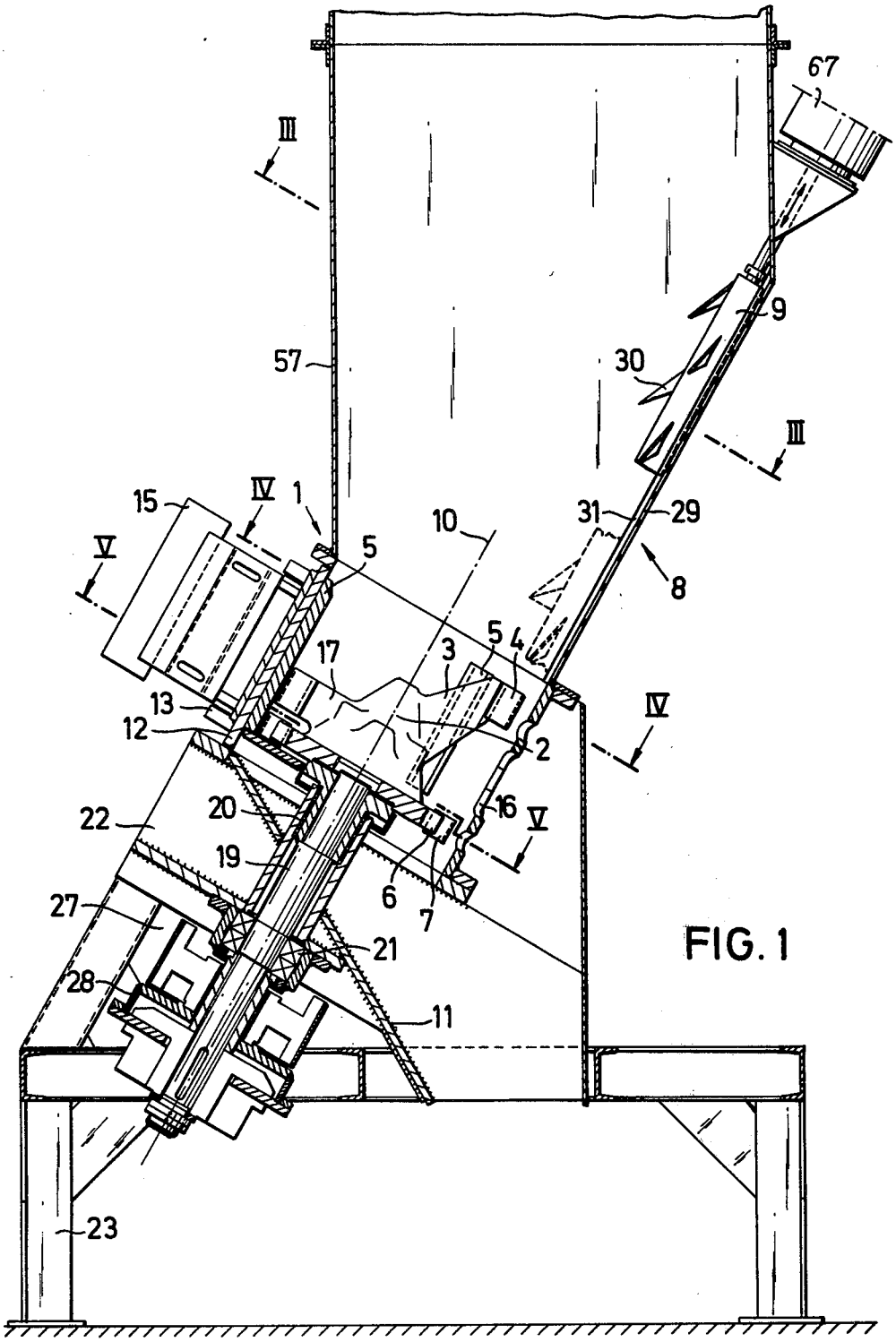
FIG. 1 is a vertical section through a comminuting apparatus according to the present invention.
Figure 2:
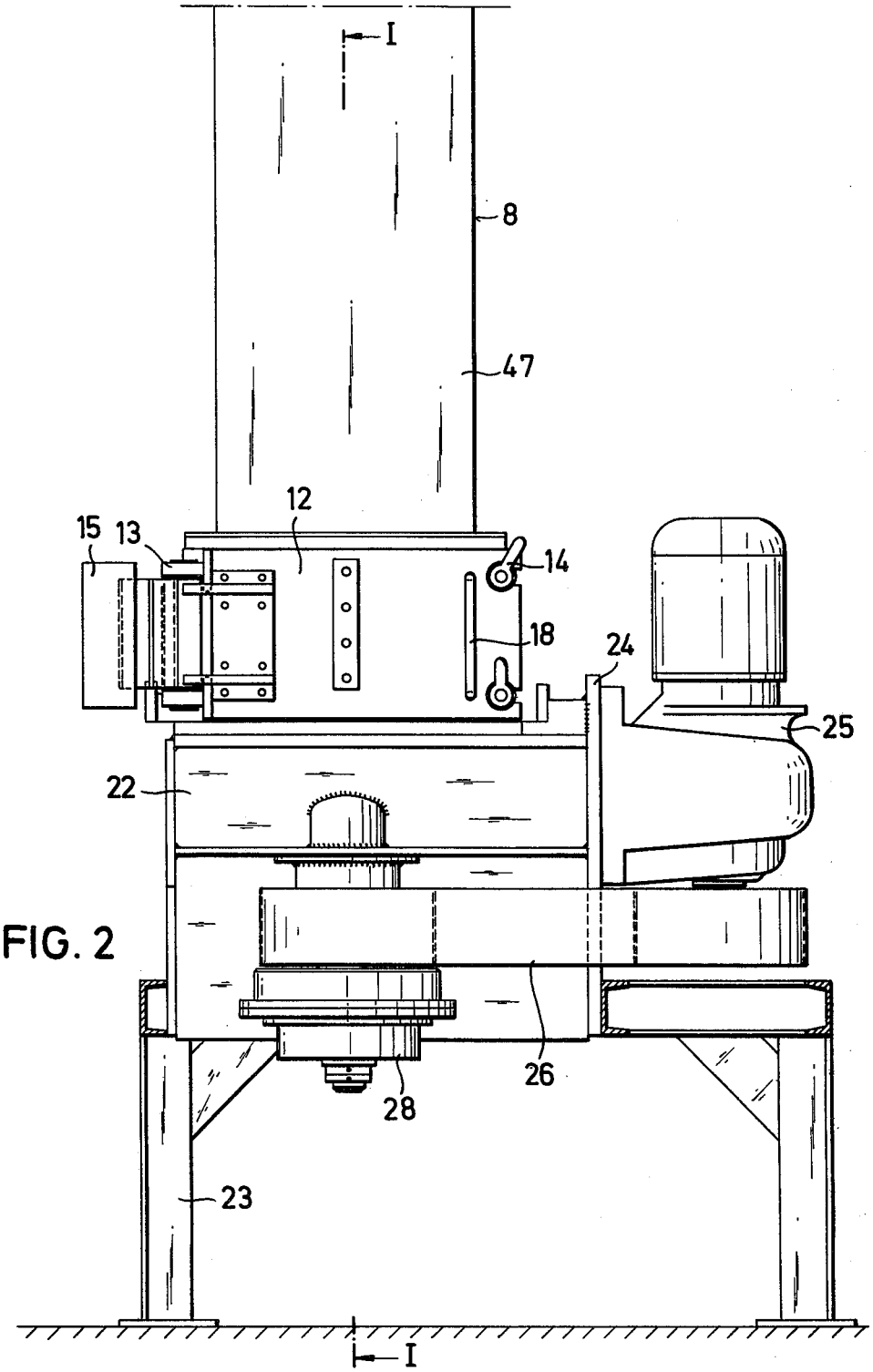
FIG. 2 is a side view of the apparatus shown in FIG. 1, line I—I of FIG. 2 indicating the plane of the section of FIG. 1.
Figure 3:
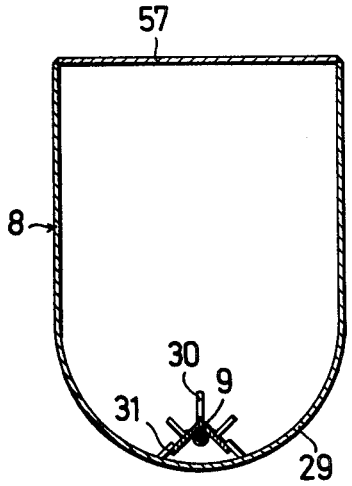
FIGS. 3, 4 and 5 are sections taken along lines III—III, IV—IV and V—V of FIG. 1, respectively.
Figure 4:
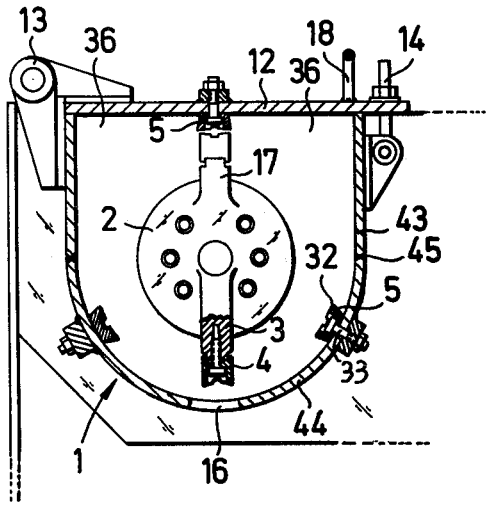

As shown in FIGS. 1–5 a comminuting apparatus stands on a support frame 23 carrying a housing base 22 on which is provided a housing 1 formed as shown in FIG. 4 of a U-shaped part in turn constituted by a pair of flat plates 43 joined at welds 45 to a part-cylindrical plate 44 and of a flat cover plate 12. A hinge 13 allows the plate 12 to pivot toward and away from the U-shaped housing part 43, 44, and several fast-closing latches 14 and provided for holding the cover plate 12 tightly down in place as shown in FIG. 4. A handle 18 is provided for the lifting of this plate 12 and a counterweight 15 facilitates its pivoting.

A rotor 2 is provided in the housing 1 rotatable about an axis 10. This rotor 2 is carried on a shaft 19 supported at its upper end in a journal 20 and at its lower end in a roller bearing 21 on the housing base 22. The lower end of the shaft 19 is connected via a slip clutch 28 to a toothed pulley 27 connected in turn via a toothed belt 26 to a drive motor 25 carried on a plate 24 on the side of the housing base 22 as shown in FIG. 2.

At the upper or inlet side of the housing 1 there is provided a funnel 8 constituted as shown in FIG. 3 by U-section plate 29 and a flat late 57. A harpoon-type feeder 9 provided with downwardly projecting hooks 30 is displaceable by means of a double-acting ram 67 along a guide 31 formed in the bight portion of the plate 29. The wall 57 extends vertically whereas the wall 29 forms a continuation of the U-section housing part 43, 44 which in turn extends parallel to the axis 10 forming an angle here of 60° to the horizontal.

The rotor 2 has a breaking arm 3 carrying at its radially outward and upper end a rotor element 4 here in the form of a blade. The housing 1 is provided with three angularly equi-shaped stator elements 5 juxtaposed with the orbit of the blade 4. In addition the rotor 3 carried at its lower or outlet end fine comminution blades or elements 6 which coact with further stator blades 7 also carried on the housing 1. The housing has at its lower end an outlet plate 1 and is formed at the bight plate 44 with outwardly flaring holes 16. An intermediate breaker arm 17 on the rotor 2 also orbits adjacent the stator elements 5 which terminate above the orbit of the element 6. It is noted that there are therefore formed triangular-section axially extending spaces 36 in the corners of the housing as shown in FIG. 4.

As also shown in FIG. 4 each of the elements 5 has opposite angularly projecting edges 32 forming an angle of between 60° and 85° with a radius drawn to the axis 10. These elements 5 are secured via bolts 33 to the respective housing parts 12 or 44.

Figure 5:
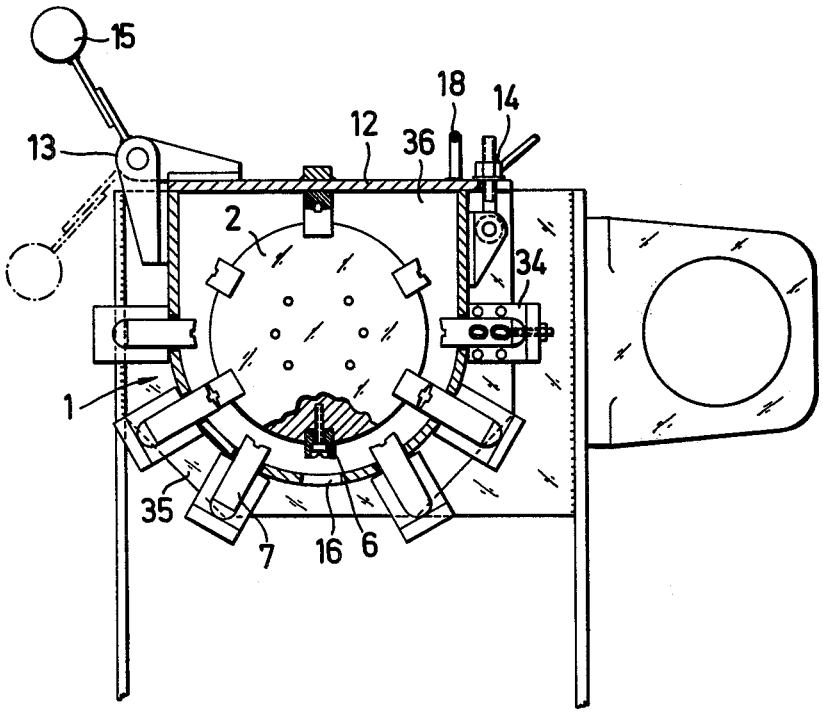
Figure 6:
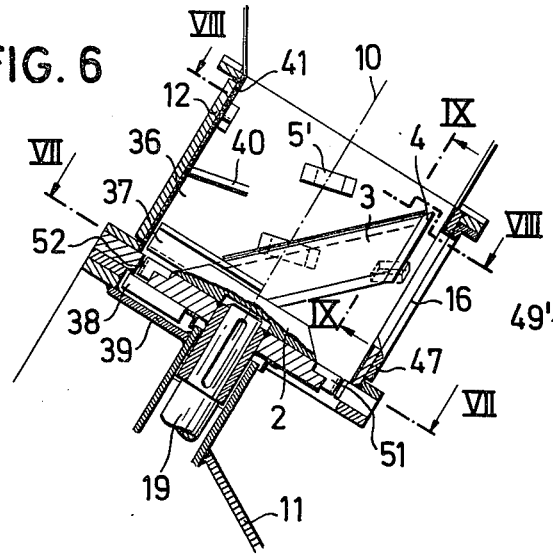
FIG. 6 is a vertical section through a detail of another embodiment of the comminuting apparatus in accordance with this invention.

FIG. 5 shows how the stator elements 7, six of which are provided in two groups of three spaced apart over 180° relative to the axis 10, are carried on adjustment blocks 34 secured to a skirt 35 on the housing 1. Thus it is possible to radially adjust these elements 7 toward or away from the orbit defined by the elements 6. Comminution will be much finer between the elements 6 and 7 than between the elements 4 and 5.

In use the turnings to be comminuted are loaded into the upper end of the hopper or funnel 8 and the ram 67 is periodically operated to push these turnings down toward the rotor 2 which moves at high speed about the axis 10. The turnings will first be shredded and coarsely comminuted by interaction of the elements 4 and 5, then by interaction of the element 4 carried on the end of the arm 17 and the elements 5. Any small pieces or oil will exit from the housing 1 at this point through the holes 16. When the turnings come down to the region of the elements 6 and 7 they will be comminuted relatively finely so as to fall out the bottom end of the housing 1 onto the plate 11 whence they can be carried away by a conveyor. Normally such comminuted turnings are then sent to a centrifuge for deoiling.

The second embodiment shown in FIGS. 6–9 uses the same reference numerals for functionally identical structure. Here, however, discrete stator elements 5' are employed having parallel upper and lower surfaces lying in respective planes forming angles between 100° and 110° to the axis 10. These elements 5' also have edges 56 which project in one or the other angular direction so as to hook and catch turnings being rotationally displaced by the rotor 2.

The intermediate arm 17 is here replaced on the rotor 2 by a shredding arm 37 which serves to pull material jammed into the corners 36 therefrom. In addition a wiper 38 immediately above the end plate 39 is provided on the lower or outlet end of the rotor 2. This wiper 38 serves to move the material to the outlet.

In this arrangement also the lower side of the housing 1 is not close by a part-cylindrical plate 44, but by flat plates 68 and 42, the latter being reinforced by a plate 47 and the former forming corners 46 with the plate 43.

The angles between the plates 42, 68 and 43 are all equal so that these plates all have center portions radially equispaced from the axis 10. Tipped triangular plates 40 are provided in the corners 36 and the housing 1 has a manganese lining 41 that reduces wear.

Figure 9:
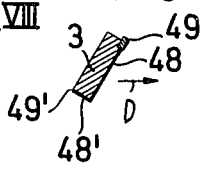
FIGS. 7, 8 and 9 are sections taken along lines VII—VII, VIII—VIII and IX—IX of FIG. 6, respectively.

As shown in particular in FIG. 9 the end 4 of the arm 3 that cooperates with the stator elements 5' has a leading face 48 which is inclined in the direction D of displacement of the arms 3 so that its leading edge 49 toward the inlet lies ahead of its trailing edge. This leading edge 49 is formed of extremely hard material such as carbide. Similarly the lower surface 48' has a trailing edge 49' which also serves to urge material down toward the outlet when the rotor 2 is reverse rotated. The inclinations of the various surfaces described above as well as the surfaces of the stator elements 5' are such that the material is normally urged by rotation of the rotor 2 downwardly in the housing 1.

Figure 7:
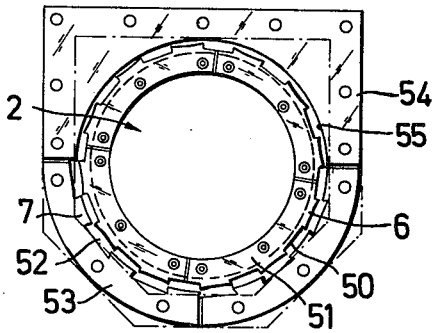

FIG. 7 shows how the rotor 2 carries four 90 degree segments 51 of a circular annulus having outer surfaces 50 from which project the fine-comminution rotor elements 6. In this arrangement twelve such elements 6 are angularly equispaced about the rotor 2. In addition on its lower half the housing 1 is formed of two similar segments 53 having an inner surface 52 from which projects the stator elements 7. These two quarter cylinders 53 are removably bolted in place like the elements 51. On its upper half a single element 54 having a smooth inner surface 55 is provided at the elements 6. The surface 55 is cylindrical and concentric with the axis A so that even loading of the rotor 2 about its entire periphery is insured.

Figure 10:
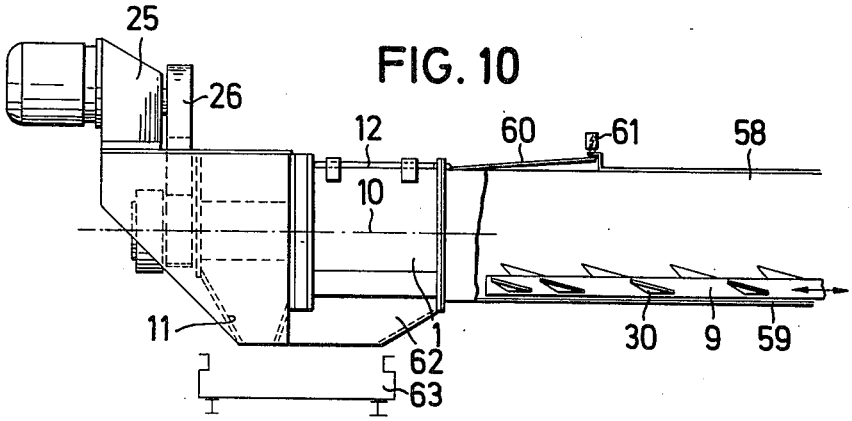
FIG. 10 is a side view partly in section through a third embodiment of the comminuting apparatus in accordance with this invention.
Figure 8:
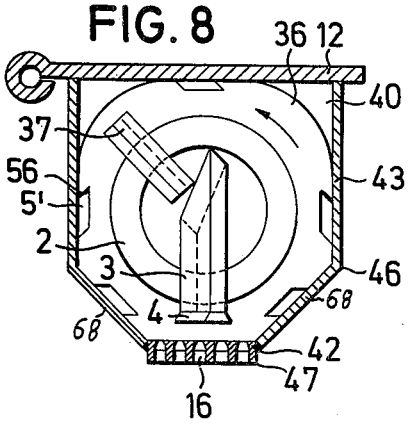

FIG. 10 shows an arrangement wherein the axis 10 is perfectly horizontal and the inlet chute or funnel has a lower wall 59 on which slides the feeder 9 and an upper wall 58 provided with an upwardly pivotal flap 60. A switch 61 cooperates with this flap 60 and when the flap 60 is pressed upwardly by a mass of material between the walls 58 and 59 this switch operates to slow down the operation speed of the ram 67 (see FIG. 1). In addition below the outlet chute 11 there is provided a downwardly opening funnel 62 opening above a conveyor 63 that leads to a deoiling station.

Figure 11:
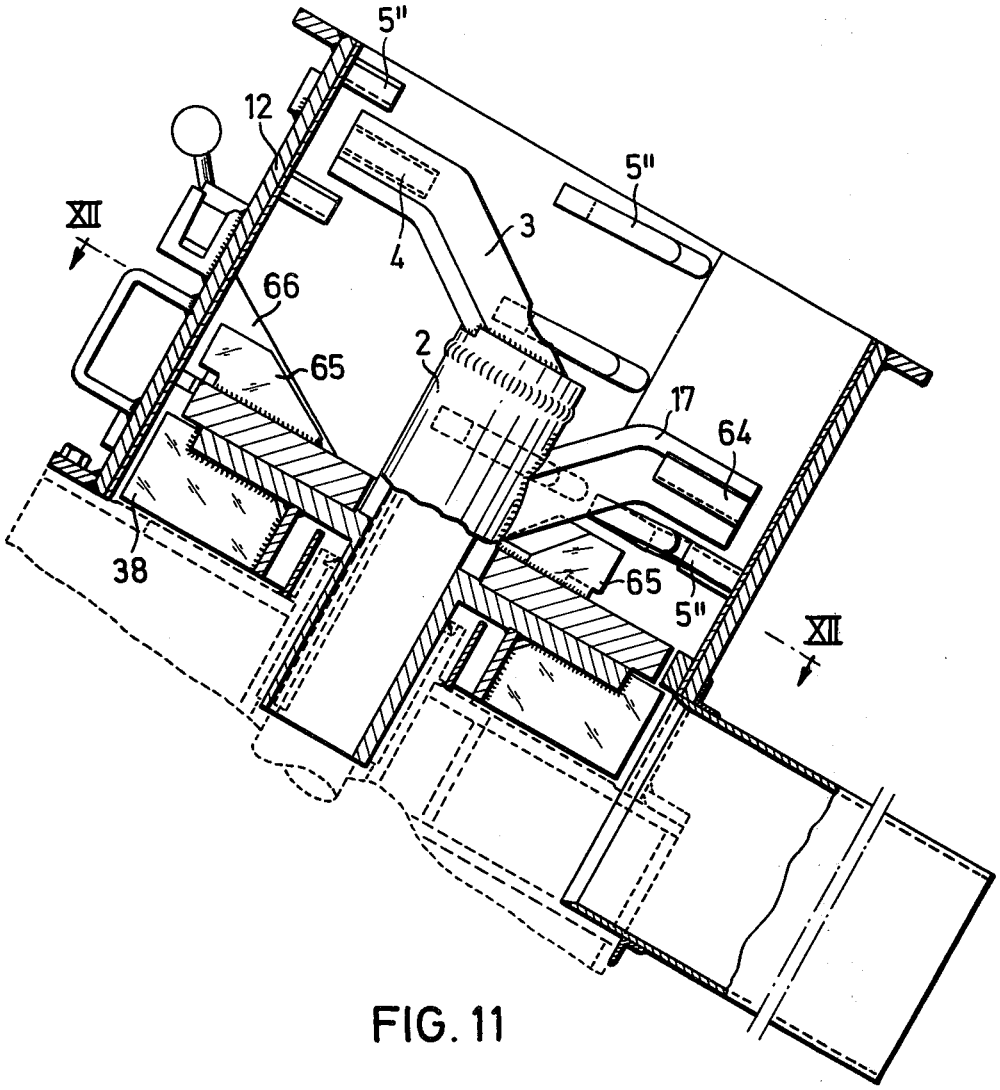
FIG. 11 is a vertical section similar to FIG. 6 through a detail of another comminuting apparatus according to the present invention.
Figure 12:
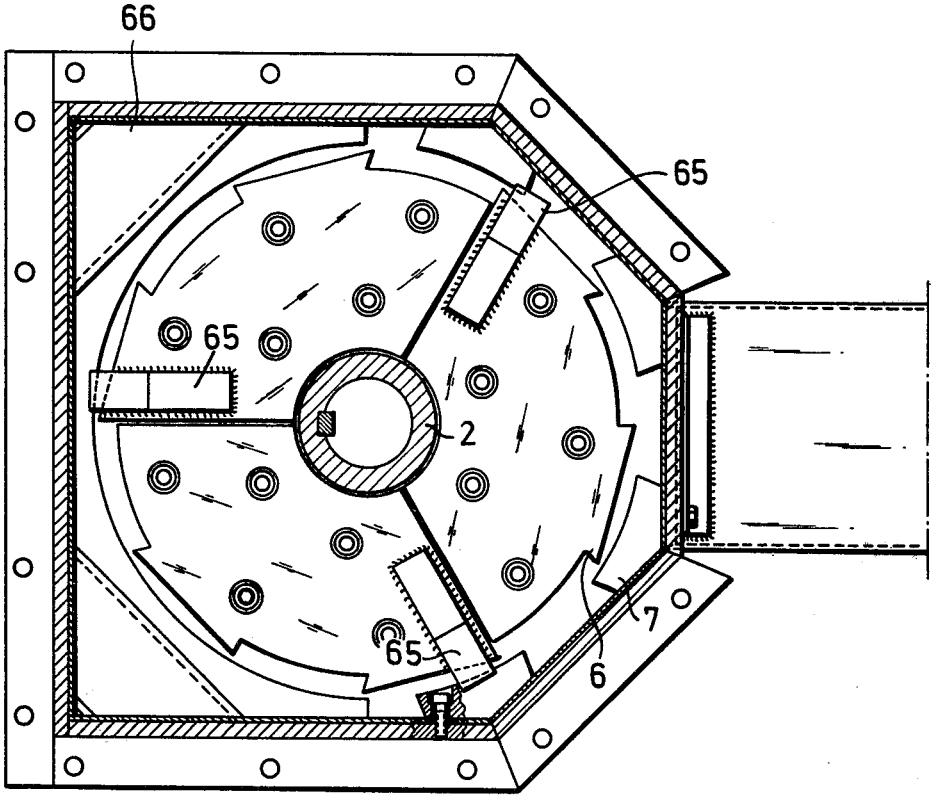
FIG. 12 is a section taken along line XII—XII of the fourth embodiment shown in FIG. 11.

Finally the arrangement as shown in FIGS. 11 and 12 has stator elements 5'' lying in three axially spaced planes perpendicular to the axis 10. The arm 3 with the element 4 extends between the outermost set of elements 5'' and the intermediate set of elements 5'''. The intermediate arm 17 carries a blade 64 and extends between the intermediate set of elements 5'' and the lowermost set of elements 5''. In addition the rotor 2 is provided on its lower side with pushers 65 and the housing 1 is provided in the corners 36 with inclined plates 66 that insure displacement of the mass being comminuted downwardly in the housing 1. These elements 66 lie at an angle of between 30° and 45° to planes perpendicular to the rotation axis 10.

With any of the arrangements according to the present invention it is therefore a relatively simple matter to open up the housing and clear any jam. Since the housing is of regular cross-sectional shape the material is not compacted as it is fed in and very few jam-ups will occur. The various orientations of the stator and rotor elements described will insure good feeding and the provision of the corners 36 allows the material to move into these regions without jamming the machine.

It will be understood that each of the elements described above, or two or more together, may also find a useful application in other types of machines differing from the types described above.

While the invention has been illustrated and described as embodied in a comminuting apparatus, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A comminuting apparatus comprising a support; a rotor carried on said support and rotatable about an axis fixed relative thereto, said rotor having an arm; at least one outer rotor element carried by said arm and at least one inner rotor-element spaced axially apart on said rotor and defining respective orbits centered on said axis on rotation of said rotor; an intermediate rotor element provided in said rotor and defining a respective orbit between the orbits of said inner and outer rotor elements; a housing part fixed on said support and surrounding said rotor spaced from said orbits, said housing part being trough-shaped and having a radially open side; a flat cover part displaceable relative to said support between a position engaged over said open side and defining with said housing part a closed interior containing said rotor and a position spaced from said side and permitting access through said open side to said interior, said parts extending parallel to said axis and forming an inlet at said outer element and an outlet at said inner element spaced from said inlet, said interior being of constant cross-sectional shape along said axis and formed with two corner spaces each extending axially and defined between said orbits, said cover part and said housing part, said corner spaces being angularly offset from each other; a plurality of stator elements on one of said parts juxtaposed with said orbits and each having a radially inwardly turned edge inclined to said axis, said stator elements being provided to both axial sides of said orbit of said outer rotor elements and extending inwardly beyond said orbit of said outer rotor element, said stator elements axially flanking said orbit of said intermediate element and extending radially inwardly therebeyond; and means for rotating said rotor about said axis and thereby comminuting material between said rotor elements and said stator element.

2. A comminuting apparatus comprising a support; a rotor carried on said support and rotatable about an axis fixed relative thereto, said rotor having an arm; at least one outer rotor element crried by said arm and at least one inner rotor element spaced axially apart on said rotor and defiing repective orbits centered on said axis on rotation of said rotor; a housing part fixed on said support and surrounding said rotor spaced from said orbits, said housing part being trough-shaped and having a radially open side; a flat cover part displaceable relative to said support between a position engaged over said open side and defining with said housing part a closed interior containing said rotor and a position spaced from said side and permitting access through said open side to said interior, said parts extending parallel to said axis and forming an inlet at said outer element and an outlet at said inner element spaced from said inlet, said interior being of constant cross-sectional shape along said axis and formed with two corner spaces each extending axially and defined between said orbits, said cover part, and said housing part, said corner spaces being angularly offset from each other, said parts being provided in each of said spaces with at leat one guide plate of generally triangular shape inclined to said axis; at least one stator element on one of said parts juxtaposed with said orbits; and means for rotating said rotor about said axis and thereby comminuting material between said rotor elements and said stator element.

3. The apparatus defined in claim 2, wherein said housing part has a pair of axially extending and generally parallel flat side portions and an axially extending part-cylindrical bight portion joining said side portions.

4. The apparatus defined in claim 2, wherein said housing part has a pair of axially extending and generally parallel flat side portions flanking said open side and a plurality of flat joining portions fixed between and joining said side portions.

5. The apparatus defined in claim 4, wherein said portions are all tangential to an imaginary cylinder centered on said axis.

6. The apparatus defined in claim 2, further comprising a hinge between said cover part and said housing part defining a pivot axis parallel to the rotor axis, and means for securing said cover part in said position engaged over said open side.

7. The apparatus defined in claim 2, wherein said rotor has a plurality of like segments each carrying a respective inner rotor element.

8. The apparatus defined in claim 2, wherein said parts are provided with a plurality of like segments at least some of which carry respective stator elements.

9. The apparatus defined in claim 8, wherein said stator elements are only provided on said housing part.

10. The apparatus defined in claim 9, wherein two of said segments are provided with respective stator elements and mounted on said housing part, two others of said segments having inner surfaces parallel to said orbits.

11. The apparatus defined in claim 2, wherein said axis is horizontal, said apparatus further comprising means for axially displacing said material through said inlet into said interior.

12. The apparatus as defined in claim 11; comprising means for reducing the feed rate of said means for axially displacing when said inlet is filled beyond a predetermined limit.

13. The apparatus as defined in claim 2; further comprising an inlet funnel at said inlet forming an axial extension of said parts.

14. The apparatus defined in claim 13, wherein said inlet funnel has a floor lying at an angle of between 50° and 75° to the horizontal.

15. The apparatus defined in claim 14, wherein said inlet funnel has an upper wall extending substantially vertically.

16. The apparatus defined in claim 13; further comprising means for moving said material axially toward said rotor in said funnel.

17. The apparatus as defined in claim 2, wherein said inner rotor element extends axially toward said outlet at least 1.0 centimeters beyond said stator element.

18. The apparatus defined in claim 2, wherein said housing part is formed at said outlet with a plurality of radially throughgoing apertures located intermediate said outer and said inner rotor elements.

19. A comminuting apparatus as defined in claim 2, wherein said arm has at least one additional such outer rotor element, the number of said inner rotor elements substantially exceeding the number of said outer rotor elements.

20. The apparatus defined in claim 2, wherein said outer rotor element has relative to a predetermined rotational direction of said rotor about said axis a leading surface with a leading edge turned away from said outlet, and a trailing surface generally parallel to said leading surface and formed with a trailing edge turned toward said outlet, said outer first stator element having a radially inwardly turned edge inclined to said axis.

21. The apparatus defined in claim 2, wherein said corner spaces are adapted to receive thereon excess comminuting material so as to prevent the latter from being superfluously compressed by said outer rotor element provided on said arm member.

22. A comminuting apparatus as defined in claim 2, wherein a plurality of such outer stator elements is provided in said housing means.

23. The apparatus defined in claim 22 wherein said outer rotor element defines an orbit, said outer stator elements being provided to both axial sides of said orbit of said outer rotor element and extending radially inwardly beyond said orbit of said outer rotor element.

24. The apparatus defined in claim 22, wherein each of said outer rotor elements is formed with a tangentially extending pointed projection.

25. The apparatus as defined in claim 22, wherein said rotor includes a flange member located adjacent to said outlet of said housing means and carrying said inner rotor element.

* * * * *